US009120028B2

(12) United States Patent
Wilson

(10) Patent No.: US 9,120,028 B2
(45) Date of Patent: Sep. 1, 2015

(54) DEVICE FOR ADAPTING TOY ROADWAY TRACK AND BRICKS

(71) Applicant: Roy Wilson, Arcade, NY (US)

(72) Inventor: Roy Wilson, Arcade, NY (US)

( * ) Notice: Subject to any disclaimer, the term of this patent is extended or adjusted under 35 U.S.C. 154(b) by 118 days.

(21) Appl. No.: 13/674,636

(22) Filed: Nov. 12, 2012

(65) Prior Publication Data

US 2014/0134915 A1 May 15, 2014

(51) Int. Cl.

| | |
|---|---|
| ***A63H 33/04*** | (2006.01) |
| ***A63H 33/06*** | (2006.01) |
| ***A63H 33/08*** | (2006.01) |
| ***A63H 18/02*** | (2006.01) |
| ***A63H 19/30*** | (2006.01) |
| ***A63H 19/34*** | (2006.01) |

(52) U.S. Cl.

CPC ..... *A63H 33/062* (2013.01); *A63H 18/02* (2013.01); *A63H 19/30* (2013.01); *A63H 19/34* (2013.01); *A63H 33/086* (2013.01)

(58) Field of Classification Search

CPC ..... A63H 19/00; A63H 21/00; A63H 19/16; A63H 19/30; A63H 19/34; A63H 19/36

USPC ..... 403/375, 293; 446/120–128, 444–446, 446/85; 238/10 F, 10 E; D21/483–505

See application file for complete search history.

(56) References Cited

U.S. PATENT DOCUMENTS

| | | | | | |
|---|---|---|---|---|---|
| D190,088 | S | * | 4/1961 | Till | D21/565 |
| 3,216,580 | A | * | 11/1965 | Fricker, Jr. | 211/41.17 |
| 3,767,114 | A | * | 10/1973 | Rossi | 238/10 E |
| D279,697 | S | * | 7/1985 | Tapdrup | D21/502 |
| D280,432 | S | * | 9/1985 | Tapdrup | D21/502 |
| 4,826,076 | A | * | 5/1989 | Hesse | 238/10 R |
| D312,486 | S | * | 11/1990 | Andersen | D21/497 |
| D312,846 | S | * | 12/1990 | Andersen | D21/497 |
| D327,518 | S | * | 6/1992 | Pagel | D21/502 |
| D345,398 | S | * | 3/1994 | Plagborg | D21/485 |
| D351,005 | S | * | 9/1994 | Hojlund et al. | D21/501 |
| 5,344,143 | A | * | 9/1994 | Yule | 273/118 R |
| D357,410 | S | * | 4/1995 | Rask et al. | D9/435 |
| D360,658 | S | * | 7/1995 | Voldmester et al. | D21/501 |
| 5,456,410 | A | * | 10/1995 | Chow | 238/10 R |

(Continued)

OTHER PUBLICATIONS

Zydac, Duplo Brick to Brio Track adapater with snap-lock, uploaded 9/9/10, Thingiverse.com, 2 pp.*

*Primary Examiner* — Gene Kim
*Assistant Examiner* — Matthew B Stanczak
(74) *Attorney, Agent, or Firm* — Vincent G. LoTempio; Kloss Stenger & LoTempio; David T. Stephenson

(57) ABSTRACT

A toy track and brick adapter for toy tracks and bricks comprising a base having a top surface and a bottom surface with indentations in the bottom surface of the base for receiving building blocks. A first arm assembly and a second arm assembly mounted to the top surface generally perpendicular to the base distally disposed in a parallel relationship to grip toy tracks. Roadway retention lips are attached to the arm assemblies which in conjunction with the tension springs hold the toy track in place within the toy track and brick adapter. Also attached to the roadway retention lips are pull-tab accessory brackets configured to releasably connect a variety of useful, functional educational accessories such as side railings, overhead signs, stoplights, traffic controls, signs and the like to increase the versatility and constructive play value of the various toy systems.

11 Claims, 3 Drawing Sheets

(56) References Cited

U.S. PATENT DOCUMENTS

| | | | | | |
|---|---|---|---|---|---|
| 5,564,962 | A * | 10/1996 | Navarrete Espinosa | ..... | 446/128 |
| 5,657,695 | A * | 8/1997 | Lanoix et al. | ..... | 104/126 |
| 5,779,145 | A | 7/1998 | Zelle et al. | | |
| D411,594 | S * | 6/1999 | Harms | ..... | D21/564 |
| 6,340,323 | B1 * | 1/2002 | Glynn | ..... | 446/89 |
| D618,737 | S * | 6/2010 | Andersen | ..... | D21/501 |
| D701,922 | S * | 4/2014 | Andersen | ..... | D21/497 |
| 2007/0111631 | A1 * | 5/2007 | Chen | ..... | 446/124 |

* cited by examiner

DEVICE FOR ADAPTING TOY ROADWAY TRACK AND BRICKS

CROSS REFERENCE TO RELATED APPLICATIONS

This application claims the benefit of U.S. Provisional Application of Roy V. Wilson, Ser. No. 61/600,513, filed 17 Feb. 2012, having the title Toy Device For Adapting Track or Roadway To Fit With Pegged Construction Bricks Or Blocks, which is incorporated herein by reference in its entirety.

FIELD OF THE DISCLOSURE

The present disclosure relates generally to a toy track adapter for wooden train sets and, more particularly, an adapter configured to connect toy train tracks or roadway tracks to toy pegged construction bricks/blocks and to connect useful, functional and educational accessories along the length of toy train or roadway tracks.

BACKGROUND

Traditional toy train tracks and roadway tracks (hereinafter known as "toy tracks") have been around for years and it is known that it takes children great planning, patience and time to set up a workable toy track layout. At first, children planned and built toy track layouts that were simply a flat design. This type of toy track layout eventually became completely impractical as children became more interested in designing more complex toy track layouts. The toy track layouts comprised of using multilevel tracks with slight elevation but were very unstable and virtually unusable, as the toy track layouts would collapse where the toy track pieces connected.

U.S. Pat. No. 5,779,145 ('145) issued to Zelle et al., addressed the problem of maintaining railroad track connectability by disclosing a track connector to secure the interlocking track connection of two train tracks of a wooden train set and effectively resist loosening and disconnecting under normal playing conditions. However, the '145 patent is limited to only a connection securing device, as the '145 patent does not allow children to adapt the toy tracks to be used in conjunction with toy pegged construction bricks and blocks (hereinafter known as "building blocks"). A simple connection-securing device limits the creativity and three-dimensional potential of the two toy systems when played with together. In addition, there is no way to attach useful, functional and educational accessories such as rails, toy trees or lights to the toy tracks. Another deficiency of a track connector without an adjustable tension spring is that various manufacturers produce different sized tracks, which can only be secured with a connection-securing device that is specifically sized to accommodate each size of track due to the dimensional variations of the track.

Thus, a heretofore unaddressed need exists in the industry to address the aforementioned deficiencies and inadequacies.

SUMMARY

The present disclosure provides a toy device for adapting train tracks or roadway tracks (hereinafter known as "toy tracks") to fit with pegged construction bricks or blocks (hereinafter known as "building blocks"), the use of attaching functional and education accessories to the toy tracks and to secure several different size pieces of toy track together. A traditional track connector does not allow children to adapt the toy tracks to be used in conjunction with building blocks.

Thus, resulting in separate play with the two toy systems, without the extreme advantage of integrating the two toy systems together, which would result in greater versatility, three-dimensional educational development, greater creativity and better understanding of construction methods. In addition, the traditional track connectors do not allow children to attach useful, functional and educational accessories to the toy tracks or to secure several different size pieces of toy track together.

Briefly described, in one embodiment, a toy track and brick adapter for toy tracks and bricks comprising, a base having a top surface and a bottom surface with indentations in the bottom surface of the base, capable of receiving building blocks, wherein mounted to the base are at least two side support ribs and tension springs, which are configured to contract and expand to accommodate various toy tracks.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
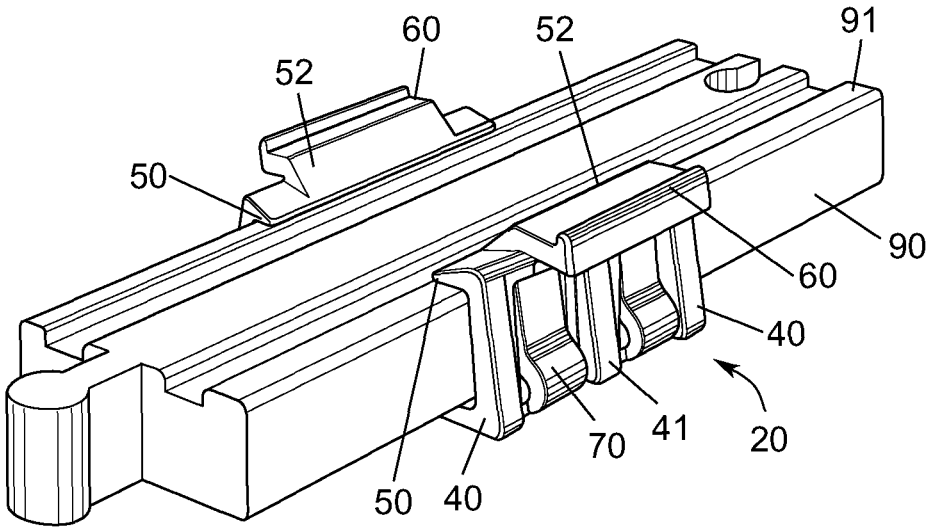
FIG. 1 illustrates a perspective view of a toy track and brick adapter constructed in accordance with the teaching of the claimed invention connected to a toy train track or roadway.

Reference is now made in detail to the description of the embodiments as illustrated in the drawings. While several embodiments are described in the connection with these drawings, there is no intent to limit the disclosure to the embodiment or embodiments disclosed herein. On the contrary, the intent is to cover all alternatives, modifications, and equivalents.

It should be clearly understood that like reference numerals are intended to identify the same structural elements, portions, or surfaces consistently through out the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Currently it is known that it takes great planning, patience and time to set up a toy train track or a roadway track system (hereinafter known as "toy tracks"). In addition, toy track designs which involve vertical lifts and multilevel tracks require support pillars at each and every track connection, thus significantly limiting toy track designs and providing a very unstable, virtually unusable layout. The toy track layouts can take hours to assemble with each support requiring minutely accurate placement and any slight deviation resulting in devastating collapse. The serviceability for children of any layout other than a flat simple design is completely impractical. A simple track connector device to secure and stabilize the interlocking track connection of two toy tracks cannot accommodate and function with various sized toy tracks. Thus, creating the problem that a child or user would need to purchase multiple sized track connectors to accommodate each different toy track size by the various manufacturers.

Simple track connectors do not allow children to play with toy tracks in conjunction with the pegged construction bricks or blocks (hereinafter known as "building blocks"). Toy tracks and building blocks are commonly found in many family homes, as they are among some of the most popular toys purchased for children by adults. Currently, when children play with toy tracks, there is no way to adapt these toy tracks to be used in conjunction with the building blocks. This connectability problem limits the child's creativity and three-dimensional potential of the two toy systems when played with together. In addition, there is no way to attach useful, functional and educational accessories to the toy tracks.

An embodiment a toy track and brick adapter for toy tracks and bricks is constructed in accordance with the teaching of the claimed invention is comprised of an adapter which has tension springs and side support ribs on both sides of the adapter, which allows the adapter to accommodate many different sized tracks varying in height and width dimensions, so that the toy tracks are held in place snugly by the adapter.

The toy track and brick adapter comprises a base having top surface and a bottom surface with indentations in the bottom surface of the base. The indentations are capable of receiving building blocks of various protrusion combinations and shapes. The indentations allow the toy track and brick adapter of the present disclosure to be connected to building blocks constructed as structures such as trestles, bridges, towers, aerial suspension supports, tunnels, caves, support columns and building structures and the like. Attached generally perpendicularly to the base are arm assemblies comprised of support ribs and tension springs to hold toy tracks of various dimensions in height and width. The side support ribs provide increased strength to the tension springs of the toy track and brick adapter. Attached to the side support ribs distal to the base are roadway retention lips, which in conjunction with the tension springs hold the toy track in place within the toy track and brick adapter. Also attached to the roadway retention lips are pull-tab accessory brackets. The pull-tab accessory brackets are configured to releasably connect a variety of useful, functional educational accessories such as side railings, overhead signs, stoplights, traffic controls, signs and the like to increase the versatility and constructive play value of the various toy systems.

Figure 1A:
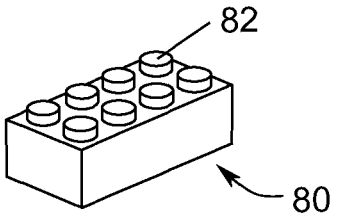
FIG. 1A illustrates a perspective view of a pegged construction bricks or blocks.
Figure 2:
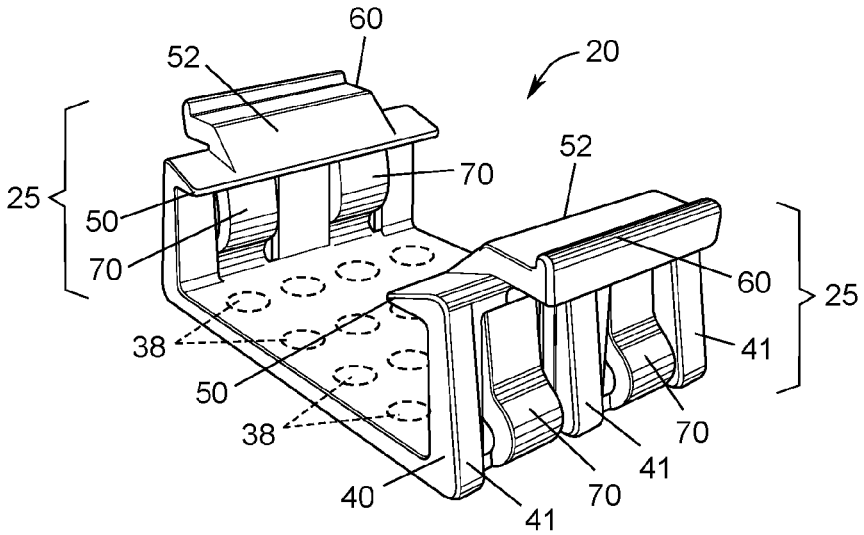
FIG. 2 illustrates a perspective view of a toy track and brick adapter constructed in accordance with the teaching of the claimed invention.
Figure 3:
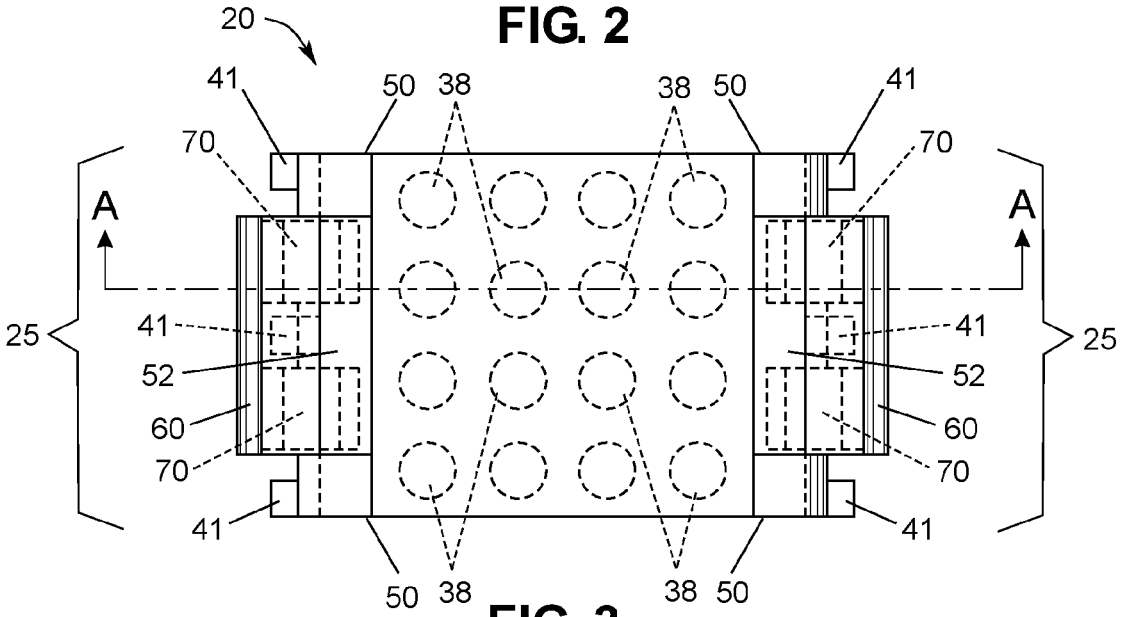
FIG. 3 illustrates a top view of a toy track and brick adapter constructed in accordance with the teaching of the claimed invention.
Figure 4:
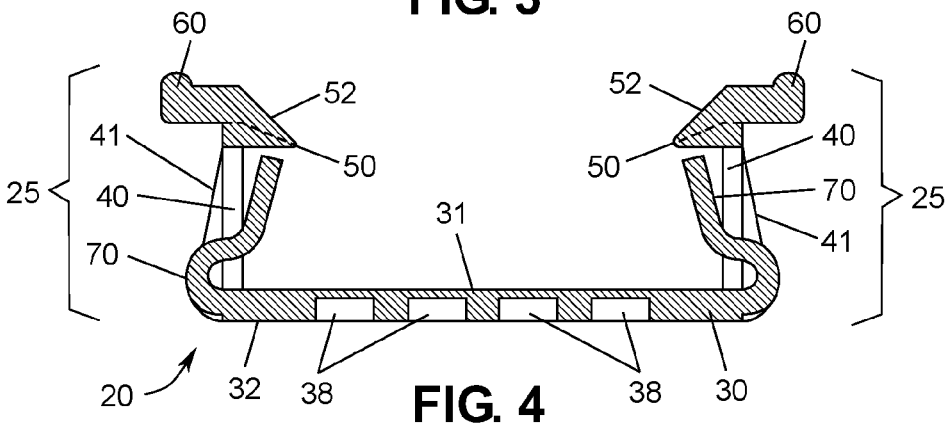
FIG. 4 is a cross-sectional view of a toy track and brick adapter taken generally along line A of FIG. 3.

Adverting now to the drawings, with reference to FIG. 1 a preferred embodiment of a toy track and brick adapter for toy tracks and bricks of the present invention is indicated generally by numeral 20 is generally comprised of a base 30 (as shown in FIG. 4) having a top surface 31 (as shown in FIG. 4) and a bottom surface 32 (as shown in FIG. 4) with a multiplicity of indentations 38 (as shown in FIGS. 2-4) located on the bottom surface 32 (as shown in FIG. 4) of the base 30 (as shown in FIG. 4). The indentations 38 (as shown in FIGS. 2-4) are capable of receiving at least one protrusion 82 (as shown in FIG. 1A) for releasably attaching the toy track and brick adapter 20 to a building block 80 (as shown in FIG. 1A).

Attached generally perpendicularly to the base 30 are arm assemblies 25 distally disposed in a parallel relationship to one another to grip a toy track 90. The arm assemblies each comprise of support ribs 40, tension springs 70, roadway retention lips 50 and pull-tab accessory brackets 60. Mounted generally perpendicular to the base 30 are side support ribs 40 which rise at a generally 90 degree angle from the base 30 or may be slightly angled inward from the base 30. The slight inward angle of the side support ribs 40 provide increased strength to the tension springs 70 allowing the toy track and brick adapter 20 to secure different size toy tracks 90. Mounted generally perpendicular to the side support ribs 40 are reinforcement members 41, with the preferred shape of reinforcement members 41 being a shape of a triangle. The reinforcement member 41 are slightly thicker proximate the base 30 and taper as it rises along the side support ribs 40 in a perpendicular direction from the base 30. Located in between the side support ribs 40 are the tension springs 70. The tension springs 70 are mounted to the base 30 and are configured in a semi-circular shape proximate the base 30 and as the tension springs 70 become distal to the base 30, the tension springs 70 flatten becoming a straight member and slightly angled inward from the base 30. Each tension spring 70 has the ability to revert rapidly to its original position after being extended, compressed, or placed under tension. The slight inward angle of the tension springs 70 allows the toy track and brick adapter 20 to secure different size toy tracks 90. For example, some toy tracks 90 have smaller lateral widths with respect to other toy tracks 90, while other toy tracks 90 may have the same lateral widths but smaller vertical heights or the toy tracks 90 may have different vertical heights and different lateral widths with respect to other toy tracks 90. Accordingly, the sloping angles the tension springs 70 will flexibly couple with smaller toy tracks 90, while expanding outwardly for toy tracks 90 with greater widths. Additionally, the side support ribs 40 and the tension springs 70 also help retain toy tracks 90 that have curved track portions or "y" track, "t" track, and any other configuration of toy track 90.

Mounted to the side support ribs 40 distal to the base 30 are roadway retention lips 50, which in conjunction with the tension springs 70 hold the toy track 90 in place. The roadway retention lips 50 project away from its respective side support rib 40, forming a cove or notch under each roadway retention lip 50. The toy track 90 has a track surface 91, which fits inside the cove of each roadway retention lip 50. The roadway retention lips 50 are of a length slightly less the track surface 91 so as to not obstruct train wheels or automobile wheels.

Figure 6:
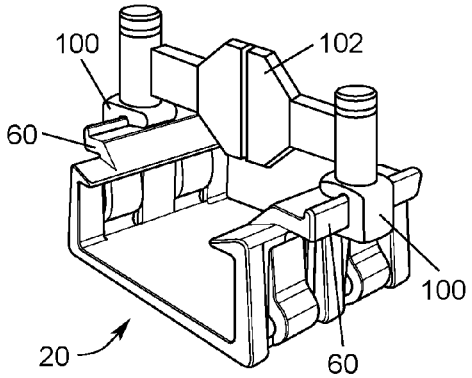
FIG. 6 illustrates a perspective view of a toy track and brick adapter assembled with an accessory removably attached to pull-tab accessory brackets.
Figure 7:
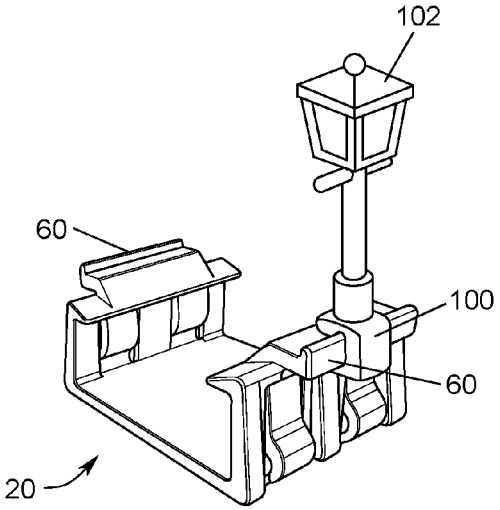
FIG. 7 illustrates a perspective view of a toy track and brick adapter assembled with an accessory removably attached to a pull-tab accessory bracket.
Figure 8:
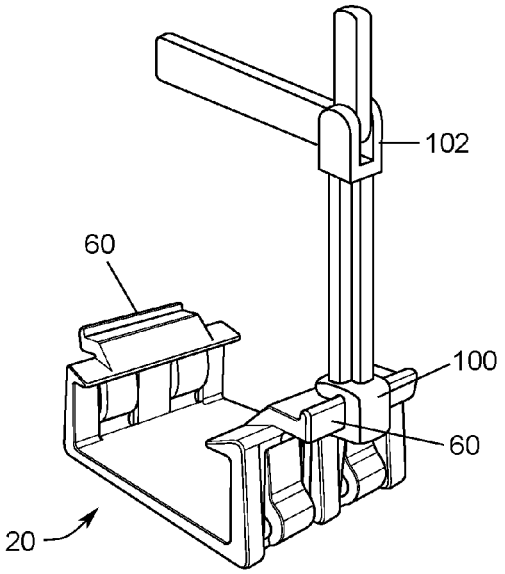
FIG. 8 illustrates a perspective view of a toy track and brick adapter assembled with an accessory removably attached to a pull-tab accessory bracket.

Mounted to the side support ribs 40 and the roadway retention lips 50 are a sloped surface 52 and pull-tab accessory brackets 60. The sloped surface 52 is of an angle, that when the toy track 90 is pressed firmly against the sloped surface 52 the side support ribs 40 will easily expand outward allowing the toy track 90 to easily slide down the sloped surface 52 and snap into the toy track and brick adapter 20. The pull-tab accessory brackets 60 protrude outwardly from the side support ribs 40, parallel to the base 30 and in an upward perpendicular direction to the side support ribs 40 forming the site where an accessory connector 100 (as shown in FIGS. 6-8) of an accessory 102 (as shown in FIGS. 6-8) may attach to the pull-tab accessory bracket 60.

Figure 1B:
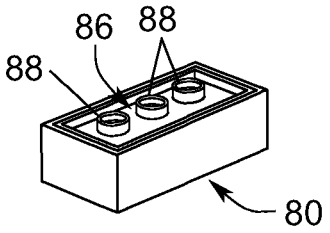
FIG. 1B illustrates a perspective view of a pegged construction bricks or blocks.

FIG. 1A depicts a building block 80 typically used in conjunction with the present invention. Building block 80 is a typical play construction bricks/blocks, which is well known in the art and combining building blocks 80 having protrusions 82 and recesses to form various building block 80 configurations. There are available a variety of building blocks 80 such as a plastic Lego blocks and the like, different in configuration; however, the standard structure of building block 80 is as shown in FIG. 1A. Building block 80 includes bricks with a plurality of protrusions 82 called knobs, bosses, or pegs and recesses. In a standard building block 80 system, the building block 80 is in the form of a rectangular box made up of two end walls, two sidewalls, and a top wall, being opened in one direction. The building block 80 has protrusions 82 on the outer surface of the top wall at equal intervals. Furthermore, FIG. 1B, has annular protrusions 8 or tubes 8 extended from the inner surface of the top wall, which is opposite to the outer surface of the wall on which the protrusions 82 are formed, to the plane defined by the outer edges of the two end walls and two side walls of building block 80. The two end walls and two sidewalls of building block 80 and the tubes 88 define a recess 86. The building block 80 shown in FIG. 1B is relatively small in thickness. The building block 80 shown in FIG. 1A is standard in thickness, and its protrusions 82 have a length in proportion to the thickness. The bottom surface 32 (as shown in FIGS. 2-4) of toy track and brick adapter 20 for toy tracks of the claimed invention has receiving indentations to accommodate protrusions 82 of building block 80. Although building blocks generally have protrusions of a circular shape, building blocks may have other shaped protrusions. It is contemplated as part of the claimed invention that receiving indentations can be made into any functional shape to accommodate various shapes of protrusions 82.

FIG. 2, illustrates a preferred embodiment of toy track and brick adapter 20 for toy tracks and bricks which is generally comprised of base 30 (as shown in FIG. 4) having top surface 31 (as shown in FIG. 4) and bottom surface 32 (as shown in FIG. 4) with a multiplicity of indentations 38 located on the bottom surface 32 (as shown in FIG. 4) of the base 30. Attached generally perpendicularly to the base 30 are arm assemblies 25 distally disposed in a parallel relationship to one another to grip a toy track 90. The indentations 38 are operatively arranged to receive at least one protrusion 82 for releasably attaching the toy track and brick adapter 20 to a building block 80. Indentations 38 depicted in FIG. 3 are of a generally circular shape, but may also be the shape of a square, hexagon or any other functional shape. The number of indentations 38 on the bottom surface 32 of the base 30 must be of a number sufficient to accommodate the building block 80. Indentations 38 are shown in broken lines on the top surface 31 of the base 30 to illustrate the location of the indentations 38 relative to the bottom surface 32.

Mounted generally perpendicular to the side support ribs 40 are reinforcement members 41, the preferred shape of reinforcement members 41 are of a shape of a triangle. With the reinforcement member 41 being slightly thicker proximate the base 30 and tapering as it rises along the side support ribs 40 in a perpendicular direction from the base 30. Located in between the side support ribs 40 are the tension springs 70. The tension springs 70 are mounted to the base 30 and are configured in a semi-circular shape proximate the base 30 and as the tension springs 70 become distal to the base 30, the tension springs 70 flatten becoming a straight member and slightly angled inward from the base 30. Each tension spring 70 has the ability to revert rapidly to its original position after being extended, compressed, or placed under tension. The slight inward angle of the tension springs 70 allows the toy track and brick adapter 20 to secure different size toy tracks 90.

Mounted to the side support ribs 40 distal to the base 30 are roadway retention lips 50, sloped surface 52 and pull-tab accessory brackets 60. The roadway retention lips 50 project away from its respective side support ribs 40, forming a cove or notch under each roadway retention lip 50. The roadway retention lips 50 are of a length slightly less then track surface 91 (as shown in FIG. 1) so as to not obstruct train wheels or automobile wheels.

The sloped surface 52 is of an angle, that when the toy track 90 is pressed firmly against the sloped surface 52 the side support ribs 40 will easily expand outward allowing the toy track 90 to easily slide down the sloped surface 52 and snap into the toy track and brick adapter 20.

Pull-tab accessory brackets 60 protrude outwardly from the side support ribs 40, parallel to the base 30 and in an upward perpendicular direction to the side support ribs 40 forming the site where accessory connector 100 (as shown in FIGS. 6-8) of accessory 102 (as shown in FIGS. 6-8) may attach to the pull-tab accessory bracket 60.

The toy track and brick adapter 20 dimensions may vary from one inch to over two inches in order to be able to hold securely straight track, curved track, "y" track, "t" track, and any other configuration of toy tracks 90 that fits within the width and height of the toy track and brick adapter 20. It may be advantageous to fabricate the toy track and brick adapter 20 as a single molded piece, made from strong but flexible plastics formulated such that the toy track and brick adapter 20 can be transparent, translucent or opaque, and meet all safety and toxicity standards. The toy track and brick adapter 20 can also be made of separate parts utilizing plastic polymers, die cast metals, or other durable material appropriately and sufficiently fastened together mechanically or with adhesive bonds. The toy track and brick adapter 20 may be manufactured by the use of complex injection molds with multiple dies and slides to form the complex shape of the toy track and brick adapter 20 or made using any one or more other well known manufacturing techniques available to those of ordinary skill in the art.

FIG. 3 illustrates a top view of a toy track adapter for toy tracks and bricks are generally comprised of base 30 (as shown in FIG. 4) having top surface 31 (as shown in FIG. 4) with a multiplicity of indentations 38 located on the bottom surface 32 of the base 30. The broken lines in FIG. 3 illustrate the location of each element relative to the bottom surface 32. The indentations 38 are constructed to receive at least one protrusion 82 for releasably attaching the toy track and brick adapter 20 to building block 80. Although in the preferred embodiment the indentations 38 in the bottom surface 32 are not through bore holes and simply indentations 38 in the bottom surface 32 of the base 30, it will be appreciated by those skilled in the art that the indentations 38 can be configured as through bore holes that are configured to accommodate protrusions 82 of building block 80.

Mounted generally perpendicular to the base 30 are side support ribs 40 (as shown in FIGS. 1-2 & 4), and in between the side support ribs 40 are tension springs 70 mounted to the base 30. Mounted to side support ribs 40 are reinforcement members 41. Also, connected to the side support ribs 40 distal to the base 30 are roadway retention lips 50. The roadway retention lips 50 project from its respective side support ribs 40, forming a cove or notch under each roadway retention lip 50. Mounted to the side support ribs 40 and the roadway retention lips 50 are the sloped surface 52 and pull-tab accessory brackets 60. The sloped surface 52 is angled to allow for coupling the toy track and brick adapter 20 to toy track 90 (as seen in FIG. 1). The pull-tab accessory brackets 60 protrude outwardly from the side support ribs 40, parallel to the base 30 and then rises in an upward perpendicular direction to the side support ribs 40 forming the site where accessory connector 100 (as shown in FIGS. 6-8) of accessory 102 (as shown in FIGS. 6-8) may attach to the pull-tab accessory bracket 60.

FIG. 4 depicts a cross-section view of the preferred embodiment of the present invention, taken generally along line A in FIG. 3 of the toy track and brick adapter 20 illustrating the base 30 having top surface 31 and bottom surface 32 with a multiplicity of indentations 38 located on the bottom surface 32 of the base 30. Indentations 38 depicted in FIG. 3 are of a generally circular shape, but may also be the shape of a square, hexagon or any other functional shape. The number of indentations 38 on the bottom surface 32 of the base 30 must be of a number sufficient to accommodate the building block 80.

Mounted generally perpendicular to the side support ribs 40 are reinforcement members 41, the reinforcement members 41 are triangularly shaped having a slightly thicker region proximate the base 30 and tapering as it rises along the side support ribs 40 in a perpendicular direction from the base 30. Located in between the side support ribs 40 are the tension springs 70. The tension springs 70 are mounted to the base 30 and are configured in a semi-circular shape proximate the base 30 and as the tension springs 70 become distal to the base 30, the tension springs 70 flatten becoming a straight member and slightly angled inward from the base 30. Each tension spring 70 has the ability to revert rapidly to its original position after being extended, compressed, or placed under tension. The slight inward angle of the tension springs 70 allows the toy track and brick adapter 20 to secure different size toy tracks 90. Therefore, the tension springs 70 will flexibly couple with smaller toy tracks 90, while expanding outwardly for toy tracks 90 with greater widths. Additionally, the side support ribs 40 and the tension springs 70 also help retain toy tracks 90 that have curved track portions or "y" track, "t" track, and any other configuration of toy track 90.

Mounted to the side support ribs 40 distal to the base 30 are roadway retention lips 50. The roadway retention lips 50 project away from its respective side support ribs 40, forming a cove or notch under each roadway retention lip 50. The roadway retention lips 50 are of a length slightly less then track surface 91 (as shown in FIG. 1) so as to not obstruct train wheels or automobile wheels.

Mounted to the side support ribs 40 and the roadway retention lips 50 are the sloped surface 52 and pull-tab accessory brackets 60. The sloped surface 52 is of an angle, that when the toy track 90 is pressed firmly against the sloped surface 52 the side support ribs 40 will easily expand outward thus allowing the toy track 90 to easily slide down the sloped surface 52 and snap into the toy track and brick adapter 20. The pull-tab accessory brackets 60 can be of any shape, design, size or material as long as allows the pull-tab accessory brackets 60 allow for the easy attachment and release of the accessories 102 (as shown in FIGS. 6-8). The pull-tab accessory brackets 60 also allow for easy release of the toy track 90 by either pressing down or pulling the pull-tab accessory brackets 60, which pulls the side supports ribs 40 and tension springs 70 away from the toy track 90, allowing for separation of the toy track 90 from toy track and brick adapter 20.

Figure 5:
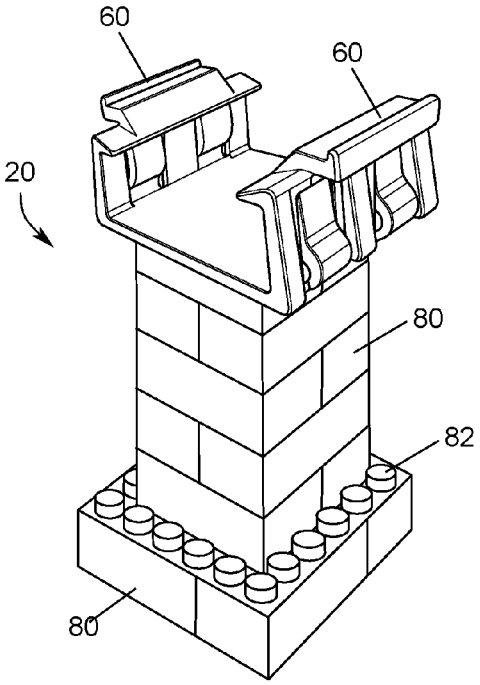
FIG. 5 illustrates a perspective view of a toy track and brick adapter assembled with a multitude of pegged construction bricks or blocks.

FIG. 5 depicts a preferred embodiment of an adapter removably attached to a multitude of building blocks 80. The building blocks 80 are constructed to releasably connect to each other, wherein the building blocks 80 can be constructed as structures such as trestles, bridges, towers, aerial suspension supports, tunnels, caves, support columns and building structures and the like. By connecting the toy track and brick adapter 20 to building blocks 80, the toy track and brick adapter 20 allows the toy track to be securely elevated in a toy track setting. Pull-tab accessory brackets 60 forms the site where accessory connector 100 (as shown in FIGS. 6-8) of accessory 102 (as shown in FIGS. 6-8) may attach to the pull-tab accessory bracket 60. Additionally, the pull-tab accessory brackets 60 can be of any shape, design, size or material as long as allows the pull-tab accessory brackets 60 allow for the easy attachment and release of the accessories 102 (as shown in FIGS. 6-8).

FIGS. 6-8 depict an embodiment of a toy track and brick adapter 20 for toy tracks and bricks of the present invention showing examples of how pull-tab accessory brackets 60, accessory connector 100 and accessories 102 interact. The pull-tab accessory brackets 60 can be of any shape, design, size or material as long as the pull-tab accessory brackets 60 allow for the easy attachment and release of the accessories 102. The accessory connector 100 is part of the accessory 102 and the accessory connector 100 is capable of attaching to the pull-tab accessory bracket 60 by way of sliding, snapping, pressing and the like. The type of accessories 102 can range from a variety of useful, functional educational accessories such as side railings, overhead signs, stoplights, traffic controls, signs and the like, which may be attached to the pull-tab accessory brackets 60.

Although exemplary embodiments have been shown and described, it will be clear to those of ordinary skill in the art that a number of changes, modifications, or alterations to the disclosure as described may be made. For example, the length, width, height, thickness, angles shape and number of indentations 38 of the toy track and brick adapter 20 could be changed to accommodate other types and dimensions of toy track 90, building blocks 80, and additional types of accessories. The pull-tab accessory brackets 60 dimensions could be changed or slightly relocated to accommodate larger accessories 102. Also, the number of side support ribs 70 could be increased to add more strength or to reduce the flexibility of the sides, depending on the material(s) used to manufacture the toy track and brick adapter 20. All such changes, modifications, and alterations should therefore be seen as within the scope of the disclosure.

What is claimed is:

1. An adapter for toy tracks and building blocks comprising:

a base having a top surface and a bottom surface with indentations in the bottom surface of said base for receiving building blocks;

a first arm assembly and a second arm assembly mounted to said top surface generally perpendicular to the base distally disposed in a parallel relationship to grip said toy track;

wherein each arm assembly is comprised of a side support rib, a pull-tab accessory bracket and a tension spring;

wherein the tension spring is configured in a curved shape proximate to the base such that when the toy track is pressed into the adapter, the tension spring is compressed, and when the toy track is in place, the tension spring grips the track.

2. The adapter of claim 1, wherein the tension spring is configured in a semi-circular shape proximate to the base.

3. The adapter of claim 1, wherein at least one reinforcement member is attached to the side support ribs between the tension springs.

4. The adapter of claim 3, wherein the reinforcement member is configured slightly thicker proximate the base and taper as it rises along the side support ribs in a perpendicular direction from the base.

5. The adapter of claim 3, wherein the each arm assembly is further comprised of a roadway retention lip.

6. The adapter of claim 3, wherein the side support ribs may expand outwardly as a toy track is slipped into the adapter.

7. The adapter of claim 3, wherein the tension spring is made from a resilient, flexible material with ability to revert rapidly to its original position after being extended, compressed, or placed under tension.

8. The adapter of claim 3, wherein the support ribs further comprise a roadway retention lip.

9. The adapter of claim 8, wherein the roadway retention lip is slightly angled downward to form a sloped surface.

10. The adapter of claim 9, further comprising of a pull-tab accessory bracket attached to the sloped surface.

11. The adapter of claim 10 wherein the pull-tab accessory bracket is capable of receiving accessory connectors.

* * * * *